United States Patent [19]

Stevens

[11] Patent Number: 4,538,633

[45] Date of Patent: Sep. 3, 1985

[54] OPTICAL-HYDRAULIC CONTROL SYSTEM

[75] Inventor: Curtis E. Stevens, Irvine, Calif.

[73] Assignee: Parker-Hannifin Corporation, Cleveland, Ohio

[21] Appl. No.: 467,690

[22] Filed: Feb. 18, 1983

[51] Int. Cl.[3] ..... F15B 13/043

[52] U.S. Cl. ..... 137/85; 60/527; 137/82; 137/625.62; 137/625.64; 251/11

[58] Field of Search ..... 137/82, 625.62, 625.64; 60/527, 529; 251/11; 137/85

[56] References Cited

U.S. PATENT DOCUMENTS

| | | | |
|---|---|---|---|
| 2,687,007 | 8/1954 | Reitz | 60/529 |
| 3,152,612 | 10/1964 | Avery | 137/625.62 X |
| 3,163,180 | 12/1964 | Campbell | 137/625.62 |
| 3,442,483 | 5/1969 | Schwartz | 251/11 |
| 3,857,541 | 12/1974 | Clark | 137/625.62 X |
| 3,866,620 | 2/1975 | Morton . | |
| 4,142,553 | 3/1979 | Sakakibara et al. | 137/625.44 |
| 4,219,181 | 8/1980 | Joelson | 251/11 X |
| 4,306,314 | 12/1981 | Griffiths | 251/131 X |
| 4,445,541 | 5/1984 | Schmiel | 137/636.2 |

*Primary Examiner*—Gerald A. Michalsky
*Attorney, Agent, or Firm*—Frederick L. Tolhurst

[57] ABSTRACT

An optical hydraulic control wherein the flow of hydraulic fluid is controlled by movement of a valve spool 12. Movement of the valve spool is initiated by a hydraulic pressure differential that is established by moving a control member 34 out of an equilibrium position. Movement of the control member from its equilibrium position is accomplished by illumination of a beam support structure 36 with an optical command signal. The control member 34 is returned to its equilibrium position after appropriate movement of a valve spool 12 by mechanical linkage between control member 34 and valve spool 12 or, alternatively, by modulation of the optical command signal.

24 Claims, 5 Drawing Figures

OPTICAL-HYDRAULIC CONTROL SYSTEM

BACKGROUND OF THE INVENTION

1. Field of the Invention

The subject invention is directed to optical control mechanisms for fluid power systems and, more particularly, optical control systems that directly control a fluid power system without the requirement of intermediate electrical or fluid stages.

2. Description of the Prior Art

Fluid power systems are used in a wide range of applications to provide the controlled movement of mechanical parts. Typically, such fluid power systems have been controlled by electromagnetic control devices responsive to electrical control signals provided from control components of the system. However, the bulk and weight of such fluid power systems tended to be undesirable for many applications. Also the electrical control circuitry of such systems was subject to interference and damage so that it required shielding or protective devices that increased the cost of the system and further contributed to its bulk and weight. Also, the relative complexity of such systems tended to make them more subject to failure. Therefore, in applications where reliability, size and weight are important considerations, a simpler, smaller, lighter control system would be desirable.

Optical-type fluid power control systems that control power components of the hydraulic system by optical control signals are known in the prior art. However, such prior optical control systems do not control the hydraulic system directly with optical signals. For example, such prior optical control systems often employ a photoelectrical receiver and a remote electrical power supply in combination with a conventional electromagnetic control component. The photoelectrical receiver was powered by a remote electrical power supply that was specially designed to reject spurious interference. Because such prior optical systems required the equipment to convert the optical control signal to an electrical control signal, they actually compounded the complexity, size and weight of the fluid control system.

Accordingly, there was a need in the prior art for an optical control system that would control the hydraulic power system directly with optical control signals and that did not require conversion to intermediate control modes. Previously, it has been accepted that the power available from optical energy sources did not permit direct control of the hydraulic system with optical signals.

SUMMARY OF THE INVENTION

In accordance with the present invention, a control system controls the differential fluid pressure between two fluid chambers in response to optical command signals. The control system includes a control member that determines the fluid pressure in the chambers by controlling fluid flow through fluid ports that are in respective communication with the chambers. The control member is supported on a thermally sensitive beam structure such that it controls fluid flow through the ports in accordance with its position relative to the ports. An optical means provides optical command signals that illuminate and thereby heat the beam structure to control the position of the control member. As specifically applied to hydraulic valves, the differential pressure between the fluid chambers controls the position of the valve spool.

Preferably, the beam structure includes a reference beam that is in parallel to a sensor beam with the reference and sensor beams being connected to the control member at one end. The reference and sensor beams are of substantially the same cross section and length so that ambient temperature variations do not result in movement of the control member with respect to the fluid ports. Also preferably, only the sensor beam is illuminated by the optical means and the control member is biased away from an equilibrium position. The optical means is then modulated to control the position of the control member.

Also preferably, as used in a hydraulic valve, feedback means are provided to sense the position of the valve spool and to control the position of the control member in response thereto. The feedback means can control the position of the control member by modulating the command signal in response to the measured position of the valve spool. Alternatively, the feedback means can be mechanically coupled between the valve spool and the control member so that it controls the position of the control member by applying counteracting torque that tends to urge the control member toward its equilibrium position.

Other details, objects and advantages of the subject invention will become apparent as the following description of certain presently preferred embodiments thereof proceeds.

BRIEF DESCRIPTION OF THE DRAWINGS

The accompanying drawings show certain presently preferred embodiments of the subject invention in which.

DESCRIPTION OF THE PREFERRED EMBODIMENT

Figure 1:
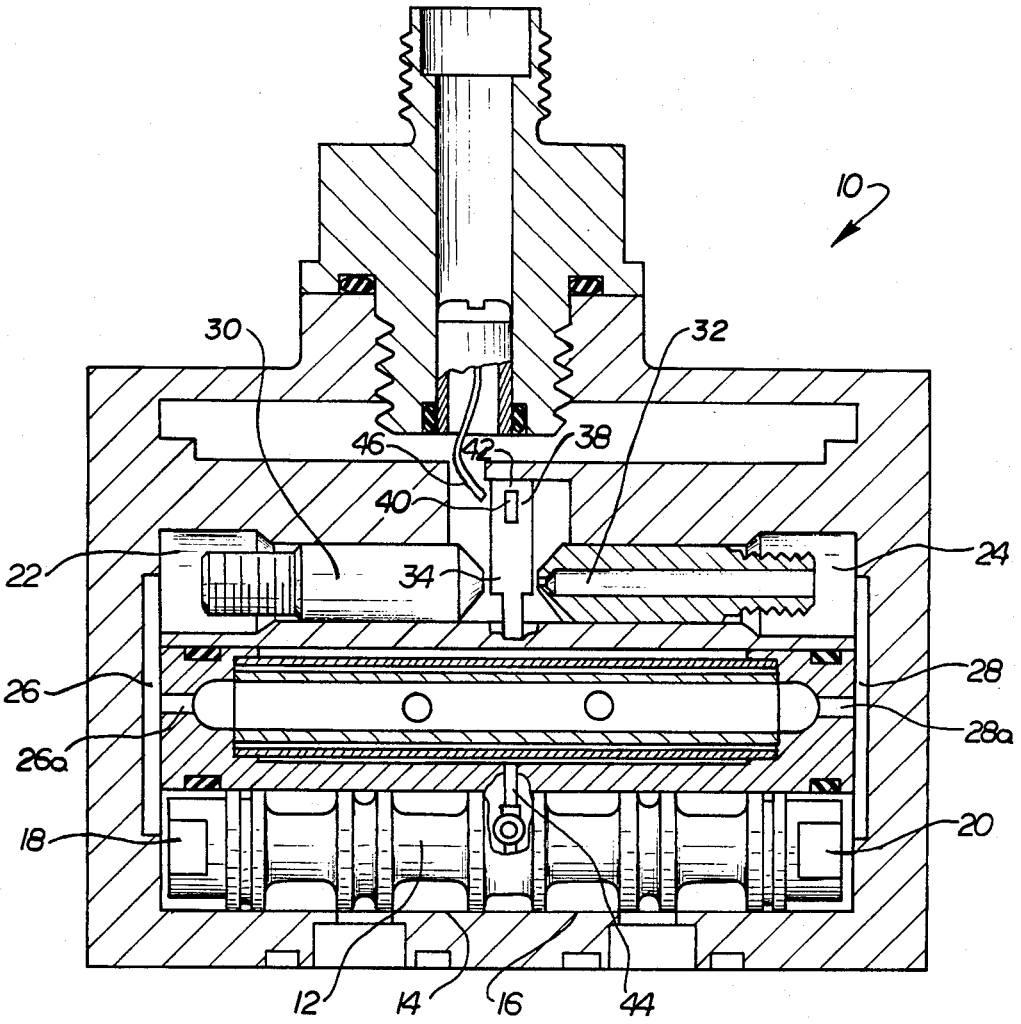
FIG. 1 is a cross-sectional view of a hydraulic servovalve that incorporates the optical-hydraulic control herein disclosed.
Figure 2:
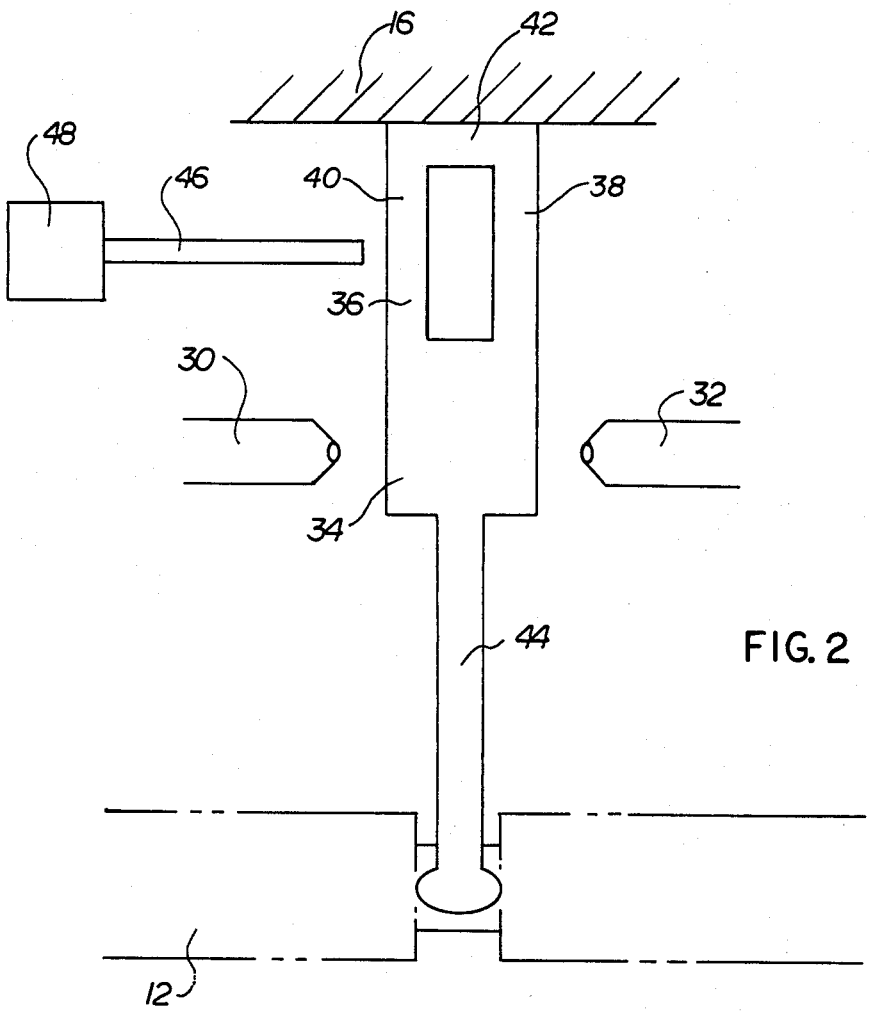
FIG. 2 is a schematic diagram of the optical-hydraulic control mechanism herein disclosed.

As shown in FIGS. 1 and 2 the preferred embodiment of the optical-hydraulic system of the subject invention is incorporated in a flapper type valve wherein a flapper controlled two-port nozzle provides differential pressure to a hydraulic slide valve. However, the subject invention is also suitable for many other hydraulic control applications. For example, as will be apparent to those skilled in the art, the disclosed optical-hydraulic system could also be applied to jet-deflector type valves such as described in U.S. Pat. No. 3,866,620 and jet pipe valves such as described in U.S. Pat. No. 2,884,986.

As shown in FIGS. 1 and 2, the operation of the valve is controlled by the position of the valve spool 12 within the cylinder 14 formed in valve body 16. Movement of valve spool 12 within cylinder 14 controls the flow of hydraulic fluid through the valve by opening and closing appropriate ports located in the cylinder wall.

The movement of valve spool 12 is controlled by the differential pressure applied to the ends 18 and 20 of valve spool 12. Ends 18 and 20 are in communication with fluid pressure chambers 22 and 24 respectively through passages 26 and 28.

Pressure chambers 22 and 24 are in communication with nozzles 30 and 32 respectively. Fluid is provided to chambers 22 and 24 through fixed orifices 26*a* and 28*a* respectively from an inlet chamber (not shown). The differential pressure between chambers 22 and 24 and, hence, the differential pressure applied to the ends 18 and 20 of valve spool 12 is determined by control of relative fluid flow through nozzles 30 and 32.

As illustrated more specifically in FIG. 2, the relative flow of fluid through nozzles 30 and 32 is controlled by the proximity of a control member 34 thereto. As shown in FIG. 2, control member 34 is at an equilibrium position where it is disposed equidistant between nozzles 30 and 32 so that the flow rate through the nozzles is substantially the same and the differential pressure between chambers 22 and 24 is substantially zero.

Integrally formed with control member 34 is a thermally sensitive beam support structure 36 that includes a reference beam 38 and a sensor beam 40. Beams 38 and 40 are in parallel alignment and are attached at one end to control member 34. At the opposite end, beam support structure 36 is connected to valve body 16 through heat sink 42. Thus, beam support structure 36 supports control member 34 from valve body 16 and maintains control member 34 between nozzles 30 and 32.

A feedback spring 44 is connected to control member 34 at the end opposite from beam support structure 36. Feedback spring 44 is coupled to valve spool 12 so that it controls the position of control member 34 in response to movements of valve spool 12.

The disclosed optical-hydraulic system further includes optical means for selectively illuminating thermally sensitive beam support structure 36 with an optical command signal to control the position of control member 34. As shown in the preferred embodiment, the optical means includes optical waveguide 46 as a means of guiding the optical command signal and an optical energy source 48 that is more specifically described with respect to FIG. 3. As used herein, the terms optical command signals and optical energy source include light energy that propagates within a broad range of wavelengths. and includes infrared and ultraviolet light as well as light in the visible spectrum.

Figure 3:
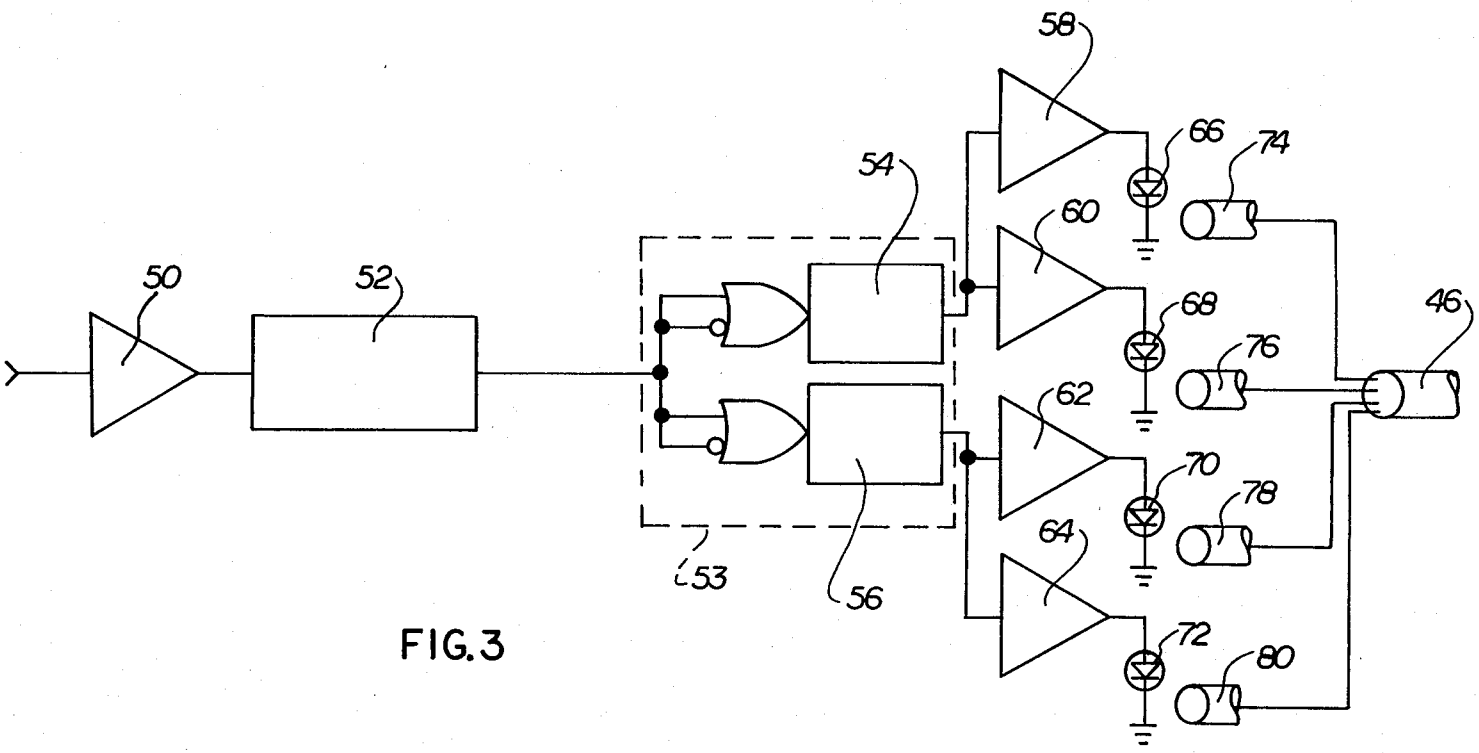
FIG. 3 illustrates an electrical-optical circuit for providing optical command signals to the optical hydraulic control mechanism.

As shown in FIG. 3, electrical input signals from a command controller or other control device are provided to a control amplifier 50. Control amplifier 50 adjusts the gain on the control signal which is then provided to a voltage-to-frequency converter 52. Voltage-to-frequency converter 52 provides an AC signal in which the frequency is proportional to the magnitude of the input signal voltage. The controlled frequency signal from voltage-to-frequency converter 52 is provided to a logic circuit that includes two one-shot multivibrators 54 and 56 connected in parallel relation. The output of multivibrators 54 and 56 is provided to amplifiers 58, 60, 62 and 64 which drive pulsed laser diodes 66, 68, 70 and 72 respectively.

The optical energy propagated from laser diodes 66–72 is provided to optical waveguides 74, 76, 78 and 80. The array of optical waveguides 74–80 is coupled with single waveguide 46 which guides the light command signals to illuminate sensor beam 40. Preferably, the optical energy that illuminates sensor beam 40 has a wavelength in the range of 0.2 to 20 micrometers.

In the operation of the preferred embodiment, to change the flow path of the hydraulic system by changing the position of valve spool 12, an appropriate command signal is provided to control amplifier 50 in the optical generator (FIG. 3). Voltage-to-frequency converter 52 converts the adjusted output voltage of amplifier 50 to an alternating signal wherein the frequency of the output signal is proportional to the magnitude of the input signal voltage. Logic circuit 53 and one-shot multivibrators 54 and 56 produce narrow pulses in response to both the rising and falling edges of the alternating signal from the frequency converter 52. The pulses produced by one-shot multivibrators 54 and 56 are amplified by amplifiers 58–64 to drive pulsed laser diodes 66–72. The optical signal from pulsed laser diodes 66–72 comprises the optical command signal that is coupled into optical waveguide 46 through optical waveguides 74–80.

Referring more specifically to FIGS. 1 and 2, the optical command signal propagated through optical waveguide 46 is directed to illuminate sensor beam 40. The design and material composition of sensor beam 40 are selected to provide adequate frequency response for control surface 34. For example, sensor beam 40 has the appropriate cross-sectional area, length, modulus of elasticity, thermal conductivity, specific heat, coefficient of thermal expansion and density to provide adequate frequency response for the particular application. For the example of the preferred embodiment, sensor beam 40 is comprised of high strength steel in the shape of a square beam having selected cross-sectional area and length, thermal conductivity of less than 1.4 watts/in°F., a coefficient of thermal expansion of at least 9/°F., and is thermally sensitive to light energy of the wavelength emited by diodes 66–72.

In the preferred embodiment, reference beam 38 is of the same design and composition as sensor beam 40 so that the two beams expand and contract at the same rate and by the same amount in response to variation in the ambient oil temperature. Thus control member 34 maintains a constant position between nozzles 30 and 32 despite fluctuations in the ambient oil temperature.

However, the illumination of sensor beam 40 by the optical command signal produces a temperature differential between beams 38 and 40 that causes beam 40 to become longer than reference beam 38. The change in the length of beam 40 causes control member 34 to move from its equilibrium position equidistant between nozzles 30 and 32 so that it establishes a differential in fluid flow through the two nozzles. The differential in fluid flow provides a pressure differential between chambers 22 and 24 which is applied through passages 26 and 28 to move valve spool 12.

As valve spool 12 moves in response to the pressure differential between ends 18 and 20, it applies a countertorque to control member 34 through feedback spring 44. This countertorque opposes the torque applied to control member 34 by the length differential between beams 38 and 40 and increases in magnitude in proportion to the displacement of valve spool 12. As is known to those skilled in the art, the valve is designed such that the countertorque produced by feedback spring 44 equals the torque induced by beams 38 and 40 at the point where the displacement of valve spool 12 corresponds to the displacement required to accomplish the change in the hydraulic flow path commanded by the input signal to control amplifier 50.

In the example of the preferred embodiment, only one beam of beam support structure 36 is illuminated by the optical command signal. Consequently, the design of beam support structure 36 is such that, with no optical signal illuminating the beam structure, it supports control surface 34 in its extreme position toward nozzle 32. Illumination of sensor beam 40 by the optical command signal causes beam 40 to elongate and provides a torque that urges control member 34 toward the other nozzle 30. The full range of positions of control surface 34 between nozzles 30 and 32 is accomplished by modulating the optical command signal that illuminates sensor beam 40. Modulation of the optical command signal can be accomplished indirectly by control of the generation of the optical signal or by direct modulation of the intensity or duration of the optical signal propagating through waveguide 46.

Alternatively, beam support structure 36 can be designed such that, with no optical signal illuminating the beam structure, it supports control surface 34 in its extreme position toward nozzle 30. In this embodiment, illumination of sensor beam 40 by the optical command signal provides a torque that urges control member 34 toward nozzle 32.

In an alternative mechanism for illuminating beam support structure 36, the optical signal can be provided through a plurality of fibers to illuminate more than one beam of the beam structure. In this case, with a zero illumination by the optical command signal, the beam support structure could support control member 34 at a position other than at the extreme position adjacent one of nozzles 30 or 32. For example, with zero illumination control surface 34 could be maintained at the equilibrium position.

The subject invention is fully compatible with the need for redundant control systems for use in aviation and other high-reliability applications. The subject optical control can be compactly arranged in redundant control systems according to any of the embodiments specifically disclosed herein as well as other embodiments that will be apparent to those skilled in the art. Moreover, any such redundant system inherently has a high degree of isolation between the redundant control channels. This is a significant improvement over prior art control systems where isolation between redundant control channels was a persistent problem that often resulted in bulky or awkward sitting control systems.

Figure 5:
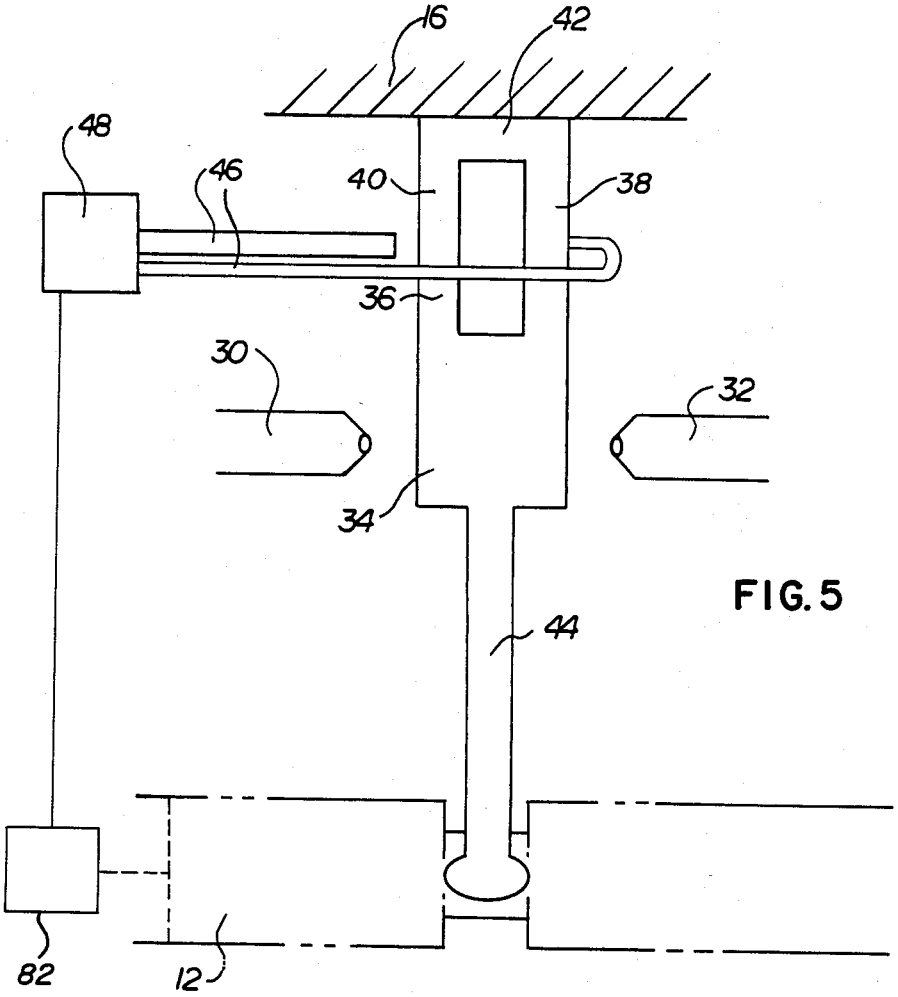
FIG. 5 is a schematic diagram of an alternative embodiment of the optical-hydraulic control mechanism herein disclosed.

Many other embodiments of the subject invention will be apparent to those skilled in the art. For example, mechanical feedback spring 44 can be supplemented or replaced by a position sensing transducer 82 (FIG. 5) connected to valve spool 12. In this case the output of the position transducer could be used as a feedback signal to modulate the optical command signal. Likewise, position sensing transducers can also be connected to the hydraulic system actuator or to the loads to provide a feedback signal for direct or indirect modulation of the optical command signal.

Figure 4:
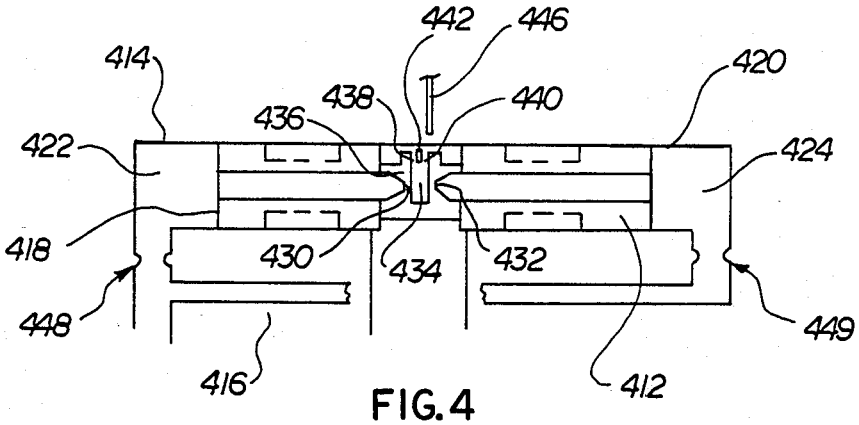
FIG. 4 shows an alternative embodiment of the subject invention wherein spool position feedback is inherently provided by mounting the control member on the valve spool.

FIG. 4 shows an alternative embodiment of the subject invention wherein the location of the flow nozzles and control member is designed to provide an inherent feedback of the valve spool position. In the optical-servo valve of FIG. 4, the operation of the valve is controlled by the position of valve spool 412 within the cylinder 414 formed in valve body 416. Movement of valve spool 412 within cylinder 414 controls the flow of hydraulic fluid through the valve by opening and closing appropriate ports located in the cylinder wall.

The movement of valve spool 412 is controlled by the differential pressure applied to the ends 418 and 420 of valve spool 412. Ends 418 and 420 form a boundary for fluid pressure chambers 422 and 424. Pressure chambers 422 and 424 are in communication with nozzles 430 and 432 respectively. Fluid is provided to both chambers 422 and 424 through input fixed orifices 448 and 449. The differential pressure between chambers 422 and 424 and, therefore, the differential pressure applied to the ends 418 and 420 of valve spool 412 is determined by control of relative fluid flow through nozzles 430 and 432.

Similar to the servo-valve described with respect to FIGS. 1–3, the relative flow of fluid through nozzles 430 and 432 is controlled by the relative proximity of a control member 434. In a manner similar to control member 34, control member 434 is at an equilibrium position where it is disposed equidistant between nozzles 430 and 432 so that the flow rate through the nozzles is substantially the same and the differential pressure between chambers 422 and 424 is substantially zero.

Integrally formed with control member 434 is a beam support structure 436 that includes a reference beam 438 and a sensor beam 440. Beams 438 and 440 are in parallel alignment and are attached at one end to control member 434. At the opposite end, beam support structure 436 is connected directly to valve spool 412 through heat sink 442. Thus, beam support structure 436 supports control member 434 from valve spool 412 and maintains control member 434 between nozzles 430 and 432.

The optical-hydraulic system of FIG. 4 further includes optical means for selectively illuminating thermal sensitive beam support structure 436 with an optical command signal to control the position of control member 434.

In the operation of the embodiment shown in FIG. 4, the optical command signal is directed through optical waveguide 446 to illuminate sensor beam 440 and cause it to elongate or constrict, depending upon the degree of modulation of the command signal. The change in length of beam 440 causes control member 434 to move from its equilibrium position equidistant between nozzles 430 and 432 to establish a differential in fluid flow and provide pressure differential between chambers 422 and 424. The pressure differential controls the movement of valve spool 412.

The embodiment of FIG. 4 is provided with inherent feedback in that control member 434 is connected to valve spool 412 through beam support structure 436. As valve spool 412 moves it moves beam support structure 436 with respect to the illumination pattern of the optical command signal. Thus, the illumination of the beam support structure 436 is directly modulated by movement of the valve spool 412 to control the position of control surface 434. Thus the position of valve spool 412, by modulating the illumination of the beam support structure 436 controls the pressure differential in chamber 422 and 424 that determines the position of valve spool 412. In comparison to the embodiments of FIGS. 1–3, this is equivalent to the function of feedback spring 44 in contributing to control of the pressure differential in chambers 22 and 24 by mechanically controlling the position of control member 34 in response to movements of valve spool 12. The inherent feedback embodiment of FIG. 4 is advantageous in that is avoids mechanical errors and variations inherent to a mechanical feedback device. Also, feedback control without a mechanical linkage will provide improved reliability and obviate the need for external mechanisms related to mechanical feedback devices that increase the overall size of the valve.

While certain presently preferred embodiments of the subject invention have been shown and described, it is to be understood that the invention is not limited thereto but can be otherwise variously embodied within the scope of the following claims.

I claim:

1. A servovalve having a valve spool that is controlled in response to differential pressure between two ports, said servovalve comprising:

a valve body that includes at least two fluid ports that are respectively in communication with two fluid chambers;

means for controlling relative fluid pressure in said fluid chambers by selectively controlling the fluid through said fluid ports;

a thermally sensitive beam structure that is mechanically connected to said valve body and to said controlling means, said beam structure maintaining said controlling means with respect to said fluid ports in response to the thermal state of said beam structure; and optical means for selectively illuminating the thermally sensitive beam structure to control the location of said controlling means with respect to said fluid ports.

2. The servovalve of claim 1 wherein said optical means comprises:

a light energy source; and an optical waveguide that is coupled to the energy source and that guides light energy emitted therefrom to illuminate said thermally sensitive beam structure.

3. The servovalve of claim 1 wherein said beam structure includes:

a reference beam that is mechanically connected to said controlling means; and a sensor beam that is disposed substantially parallel to said reference beam and is mechanically connected to said controlling means.

4. The servovalve of claim 2 or 3 wherein said thermally sensitive beam structure has a coefficient of expansion of at least 9/°C.

5. The servovalve of claim 2 or 3 wherein said thermal sensitive beam structure has a thermal conductivity of less than 1.4 watts/in°F.

6. The servovalve of claim 2 or 3 wherein said optical means illuminates the thermally sensitive beam structure with light energy having a wavelength in the range 0.2 to 20 micrometers.

7. A servovalve that provides a differential pressure between two output ports in response to optical wavelength command signals, said servovalve comprising:

a valve body that includes two differential output passageways that are in communication with the output ports;

means for controlling fluid pressure in the output passageways by controlling the fluid flow through the ports;

first and second thermally sensitive beams that are mechanically connected to said controlling means and to said valve body, said thermally sensitive beams supporting said controlling means with respect to the ports; and optical means for selectively illuminating at least one of the thermally sensitive beams with light energy to control fluid pressure at said output passageways by pivoting said controlling means on said thermally sensitive beams.

8. The servovalve of claim 7 wherein the optical means comprises at least one optical waveguide that illuminates a respective one of the thermally sensitive beams.

9. The servovalve of claim 8 having at least two optical waveguides and wherein the thermally sensitive beams pivot said control member in response to light intensity differential between two of said optical waveguides.

10. The servovalve of claim 7 further comprising a heat sink that is connected to one end of said thermally sensitive beams.

11. An optical control for hydraulic valves wherein the flow of fluid is controlled by the position of an internal valve spool, said control comprising:

means for controlling the flow of hydraulic fluid, said control means having an equilibrium position where the valve spool is maintained in steady state condition, said control means being movable away from the equilibrium position to determine movement of the valve spool;

a reference beam that is mechanically connected to said controlling means, said reference being responsive to variations in ambient temperature;

a sensor beam that is mechanically connected to said controlling means, said sensor beam being responsive to variations in ambient temperature and also being responsive to light energy;

an optical energy source; and means for guiding the optical energy from said energy source and illuminating the sensor beam to control the movement of said controlling means.

12. The optical control of claim 11 wherein the reference beam and sensor beam have cross-sectional and longitudinal dimensions and wherein the dimensions of said reference beam are substantially equal to the dimensions of said sensor beam.

13. The optical control of claim 11 wherein said reference beam is in substantially parallel alignment with said sensor beam.

14. The optical control of claim 13 wherein the controlling means is connected to one end of said reference beam and to a corresponding end of said sensor beam.

15. The optical control of claim 13 wherein the controlling means is connected to one end of said reference beam and a corresponding end of said sensor beam and further comprising:

a heat sink that is connected to the opposite end of said reference beam and a corresponding end of said sensor beam.

16. The optical control of claim 11 further comprising:

feedback means connected to the valve spool for sensing the position of said valve spool and controlling said optical energy source in response to the sensed position.

17. The optical control of claim 11 further comprising:

feedback means connected to the valve spool and to the controlling means, said feedback means controlling the position of the controlling means in response to changes in the position of said valve spool.

18. The optical control of claim 17 wherein said feedback means opposes the movement of said controlling means by said sensor beam.

19. The optical control of claim 17 wherein said feedback means urges said controlling means towards its equilibrium position.

20. The optical control of claim 17 wherein said sensor beam biases said controlling means toward an extreme position away from the equilibrium position, and wherein said guide means comprises an optical waveguide that illuminates the sensor beam to move said controlling means away from the extreme bias position.

21. The optical control of claim 20 wherein the optical power provided by said guide means is modulated to control the position of said controlling means.

22. The optical control of claim 17 wherein said guide means comprises first and second optical waveguides, the first optical waveguide illuminating said reference beam and the second optical waveguide illuminating said sensor beam such that the controlling means is controlled by the differential power provided by the first and second optical waveguides.

23. The optical control of claim 11 further comprising:

feedback means responsive to movement of the valve spool, said feedback means modulating the energy propagated through said guiding means in response to movement of the valve spool to return said controlling means to its equilibrium position.

24. The optical control of claim 11 wherein said reference beam and said sensor beam are connected to the valve spool.

* * * * *